US005988475A

United States Patent [19]

Han

[11] Patent Number: 5,988,475

[45] Date of Patent: Nov. 23, 1999

[54] STRAPS FOR CARRYING GOLF BAGS

[76] Inventor: Dong Kyu Han, 219 S. Primrose St., Anaheim, Calif. 92804

[21] Appl. No.: 08/788,903

[22] Filed: Jan. 23, 1997

[51] Int. Cl.[6] ..... A45F 3/04

[52] U.S. Cl. ..... 224/608; 224/627

[58] Field of Search ..... 224/645, 608, 224/613, 614, 615, 627, 643

[56] References Cited

U.S. PATENT DOCUMENTS 5,038,984 8/1991 Izzo ..... 224/643
5,042,703 8/1991 Izzo ..... 224/643
5,042,704 8/1991 Izzo ..... 224/643
5,413,261 5/1995 Wu ..... 224/614 X

*Primary Examiner*—Renee S. Luebke
*Attorney, Agent, or Firm*—Loeb & Loeb LLP

[57] ABSTRACT

A dual shoulder strap device attachable to a standard golf bag to allow a golfer to carry the golf bag centered on his back. For example, the dual shoulder strap device is made from a single piece to prevent twisting and entangling of the two separate shoulder straps. Alternatively, the dual shoulder straps are connected to tracks built into a coupler, in which the tracks allow the shoulder straps to be adjustable to the differing widths of the golfer's shoulders.

8 Claims, 8 Drawing Sheets

STRAPS FOR CARRYING GOLF BAGS

BACKGROUND OF THE INVENTION

1. Field of the Invention

The present invention relates to golf accessories. More specifically, embodiments of the present invention are directed to straps attachable to a golf bag allowing a person to carry the golf bag on his back by placing the straps over both shoulders.

2. Related Art

Traditionally, the golf bag came with a single strap where one end was attachable to the top of the golf bag and the other end to a mid-point on the bag. The golfer would then carry the bag by placing one arm through the single strap and carrying the bag over one shoulder. However, due to the combined weight of the golf clubs and the bag, the shoulder used to carry the golf bag would experience increased strain and soreness. Additionally, the imbalance would also cause strain on the lower back and hip.

Recently, a type of dual carrying strap containing two shoulder straps has been used in place of the single strap. By placing a shoulder strap over each shoulder, the dual carrying strap works like a backpack. Thus, the dual carrying strap centers the weight of the golf bag on the back of the golfer for better balance and weight distribution. However, these dual shoulder straps would easily get twisted before the straps could be placed on the shoulders of the golfer. Additionally, the extra straps required in these dual carrying straps made the golf bag unattractive to golfers. Furthermore, the dual carrying straps were difficult to adjust for the different shoulder widths of golfers.

SUMMARY OF THE DISCLOSURE

It is an object of an embodiment of the present invention to provide an improved dual carrying strap for golf bags, which obviates the above limitations and which once attached to a golf bag centers the weight of the golf bag on the back of the golfer and does not twist during use. Another object of the present invention is to provide an improved dual carrying strap which is attachable to most variations of the standard golf bag design. A further object of the present invention is to reduce the number of required straps to a minimum to aesthetically improve the appearance of the dual carrying straps. Yet another object of another embodiment of the present invention is the ability for the dual carrying straps to adjust automatically to the width of the golfer's shoulders to provide even distribution of the weight of the golf bag.

According to an embodiment of the present invention, the dual carrying strap is formed from a single generally U-shaped strap. In particular, the carrying strap apparatus is for use with a golf bag having a top opening and an outer sidewall and a first coupler secured near the opening of the golf bag, a second coupler secured near the mid-section of the golf bag, and a third coupler secured in between the first and second couplers. The carrying strap apparatus has a generally U-shaped strap having first and second ends. The first end is attachable to the first coupler of the golf bag and the second end is attachable to the second coupler of the golf bag. A connector member is attached between the generally U-shaped strap and the third coupler of the golf bag. When the first and second ends of the generally U-shaped strap and the connector member are attached to the golf bag, two openings are defined for wearing the U-shaped strap over both shoulders.

According to further embodiments of the present invention, the generally U-shaped strap is curved to fit the contours of a person's back. In addition, the connector member is adjustable in length and has first and second ends, in which the first end is coupled substantially near the center of the generally U-shaped strap and the second end is coupled to the third coupler of the golf bag.

According to another embodiment of the present invention, the carrying strap apparatus includes a coupling member, a first elongated member and a second elongated member. The coupling member is connected to the third coupler of the golf bag. The first elongated member has first and second ends where the first end of the first elongated member is slidably coupled to the coupling member and the second end is attachable to the first coupler of the golf bag. The second elongated member has first and second ends where the first end of the second elongated member is slidably coupled to the coupling member and the second end is attachable to the second coupler of the golf bag. When the first and second elongate members are attached to the golf bag, two openings are defined for wearing the carrying strap apparatus on the back of a person.

The coupling member of the above embodiment has first and second tracks for slidably coupling the first and second elongated members, respectively. Each one of the first ends of the first and second elongated members have an engaging member having a substantially spherical shape for installing in the first and second tracks. Furthermore, the coupling member may have a third track for slidably coupling the connector member to the coupling member.

Moreover, each one of the second ends of the first and second elongated members is attached to the golf bag through a rotatable connector so that the first and second elongated members is independently rotatable with respect to the coupling member without twisting. Similarly, the coupling member may be attached to the golf bag through a rotatable connector so that the coupling member is rotatable with respect to the golf bag.

BRIEF DESCRIPTION OF THE DRAWINGS

Other features and advantages of the invention will become apparent from the following detailed description, taken in conjunction with the accompanying drawings which illustrate, by way of example, the various features of embodiments, of the invention, and in which.

DETAILED DESCRIPTION OF THE PREFERRED EMBODIMENTS

Figure 1:
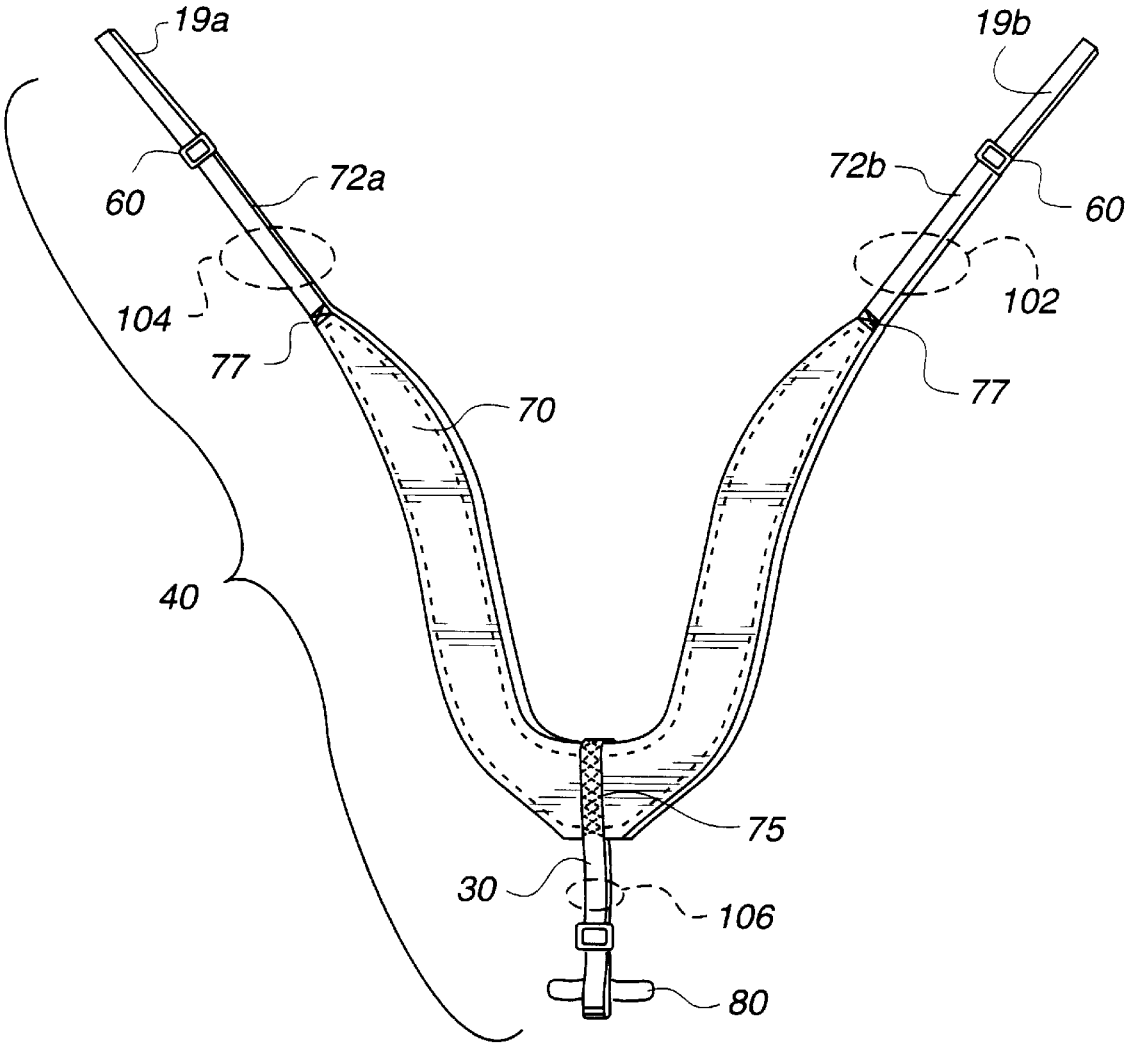
FIG. 1 is a frontal view of carrying straps in accordance with one embodiment of the present invention.

A carrying strap assembly for golf bags in accordance with a preferred embodiment of the present invention is shown in the drawings for purposes of illustration. However, it should be recognized that further embodiments of the invention may be used in other types of bags, such as tote bags, sports/ski bags, luggage and the like.

Figure 2:
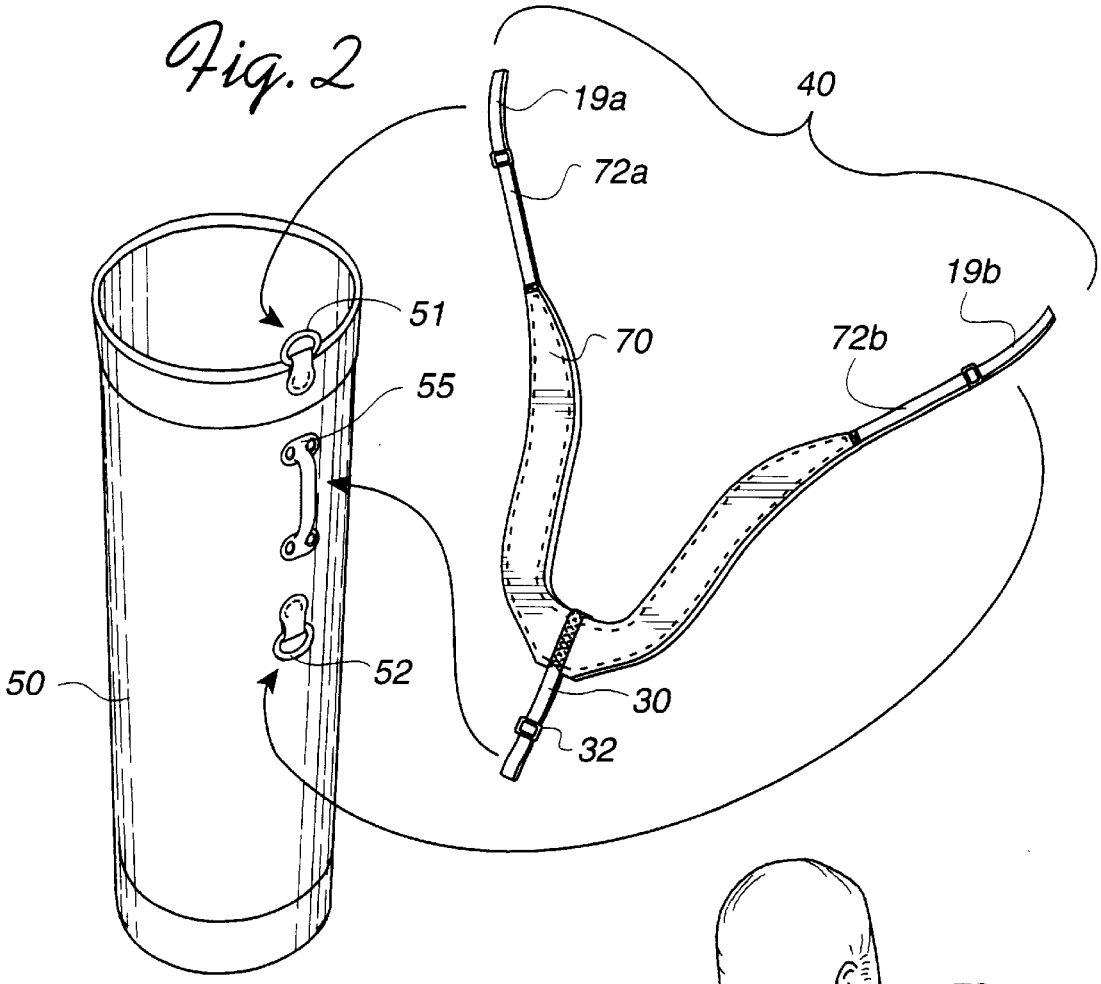
FIG. 2 is a perspective view of the carrying straps of FIG. 1 attached to a golf bag.

FIGS. 1 and 2 show an embodiment of the a carrying strap 40 in accordance with the present invention used to support a golf bag 50. The carrying strap is essentially comprised of a shoulder strap 70 with a connector strap 30 attached substantially near the center of the shoulder strap 70.

In the preferred embodiment, as shown in FIG. 1, the shoulder strap 70 is a generally U-shaped strap that can be placed over both shoulders and which can be manufactured or constructed from a single piece of material. Because the shoulder strap 70 is not formed from two separate shoulder straps, there is less of a tendency for the straps to entangle or twist as compared to the two shoulder straps. Also, in a preferred embodiment, the shoulder strap 70 is made with a sufficient width and thickness that prevents the strap from twisting on itself. Furthermore, since the carrying strap 40 has only one shoulder strap 70, there are fewer dangling parts hanging off the golf bag 50 once the carrying strap 40 is attached and less connection points to the golf bag 50.

As further seen in FIG. 1, the carrying strap 40 also includes a connector strap 30 and two end straps 72*a* and 72*b*. In the preferred embodiment, the top portion of the connector strap 30 is wrapped around the center portion 75 of the shoulder strap 70 and stitched onto the shoulder strap 70. Additionally, the two end straps 72*a* and 72*b* are stitched onto the ends 77*a* and 77*b* respectively, of the shoulder strap 70. Alternative to stitching, the end straps 72*a* and 72*b* may be attached to the ends 77*a* and 77*b* using suitable fasteners, such as rivets, adhesives or the like. Though the shoulder strap 70 can be manufactured to include the end straps 72*a* and 72*b* as one solid piece, the use of separate end straps 72*a* and 72*b* may ease manufacturing. Since end straps 72*a* and 72*b* are commonly available for use in backpacks and other applications, the end straps can be purchased separately, cut to a desired length, and stitched on quite easily.

Figure 12:
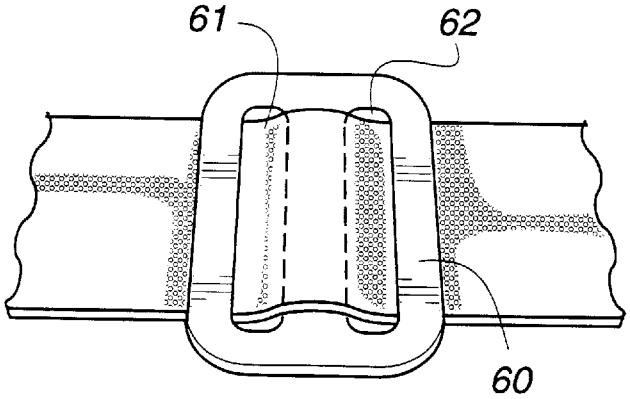
FIG. 12 is a frontal view of an adjustable buckle used in the preferred embodiment of the present invention.

As shown in FIG. 2, the carrying strap 40 is mounted to a golf bag 50 where the end 19*a* of the end strap 72*a* is connected to a ring 51 on the upper rim of the golf bag 50, the end 19*b* of the end strap 72*b* is connected to a ring 52 on or about the mid-point of the golf bag 50, and the connector strap 30 is attached to a handle 55 or a third ring (not shown) located between the rings 51 and 52 which is securely mounted on the golf bag 50. The rings 51 and 52 (or similarly shaped parts) may be preattached to the standard golf bag 50 by fasteners, such as screws or rivets or the like. In the preferred embodiment, two adjustable buckles 60, shown in detail in FIG. 12, are used to connect the ends 19*a* and 19*b* to the rings 51 and 52, respectively. The ends 19*a* and 19*b* are passed through a first hole 61 and out a second hole 62 of the adjustable buckle 60. Then, the ends 19*a* and 19*b* are passed through their respective rings 51 and 52, and then passed once again through the opposite side of the first hole 61 to fasten the two ends 19*a* and 19*b* to the golf bag 50. Additionally, the strap connector 30 is secured to a handle 55 of the golf bag 50 by passing through the handle 55 and fastened back on itself through a buckle 32 (similar to the shown in FIG. 12). Once the strap connector 30 is fastened back on itself, there is a Velcro strip 80 which can be wrapped around the strap connector 30 to keep the overlapped strap connector 30 together. Thus, the strap connector 30 connects the shoulder strap 70 to the golf bag handle 55 with a minimal amount of loose parts. Alternatively, a clip or spring lock may be used to secure either the strap connector 30 to the handle 35 or the end straps 72*a* and 72*b* to the rings 51 and 52, respectively.

Figure 3:
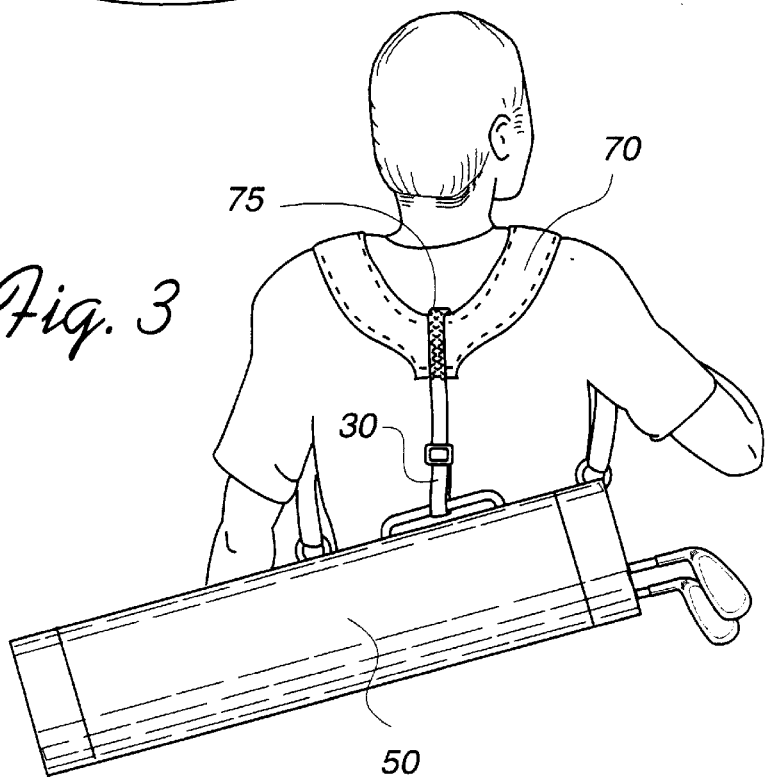
FIG. 3 is a rear view of a person carrying a golf bag utilizing the carrying straps of FIG. 1.

Therefore, as seen in FIGS. 2 and 3, the carrying strap 40 by being attached to the golf bag 50 forms two openings where an individual can insert his arms through and subsequently place the strap 70 over his back to center the weight of the golf bag 50 on the person's back.

In the preferred embodiment of the present invention, the shoulder strap 70 is made from resilient and preferably padded materials, such as canvas or polyester. However, other materials, such as nylon, plastic or the like, may be used. The shoulder strap 70 is preferably at least four feet long in length to ensure that where the shoulder strap 70 comes into contact with the shoulder blade or collar bone, or any other bone, so that the shoulder strap 70 provides cushioning for comfort. However, a shorter strap may be used if embodiments of the present invention is practiced in other bags, such as tote bags, or the like. Additionally, longer or shorter straps may be used to accommodate differences in people's physique.

FIGS. 4 through 7 show another preferred embodiment of the carrying strap 140 used to support a golf bag 50. Though the embodiments are slightly different, corresponding parts use the same identification number. The carrying strap 140 is essentially comprised of a coupler 20, two shoulder straps 10*a* and 10*b*, and a connector strap 30.

Figure 4:
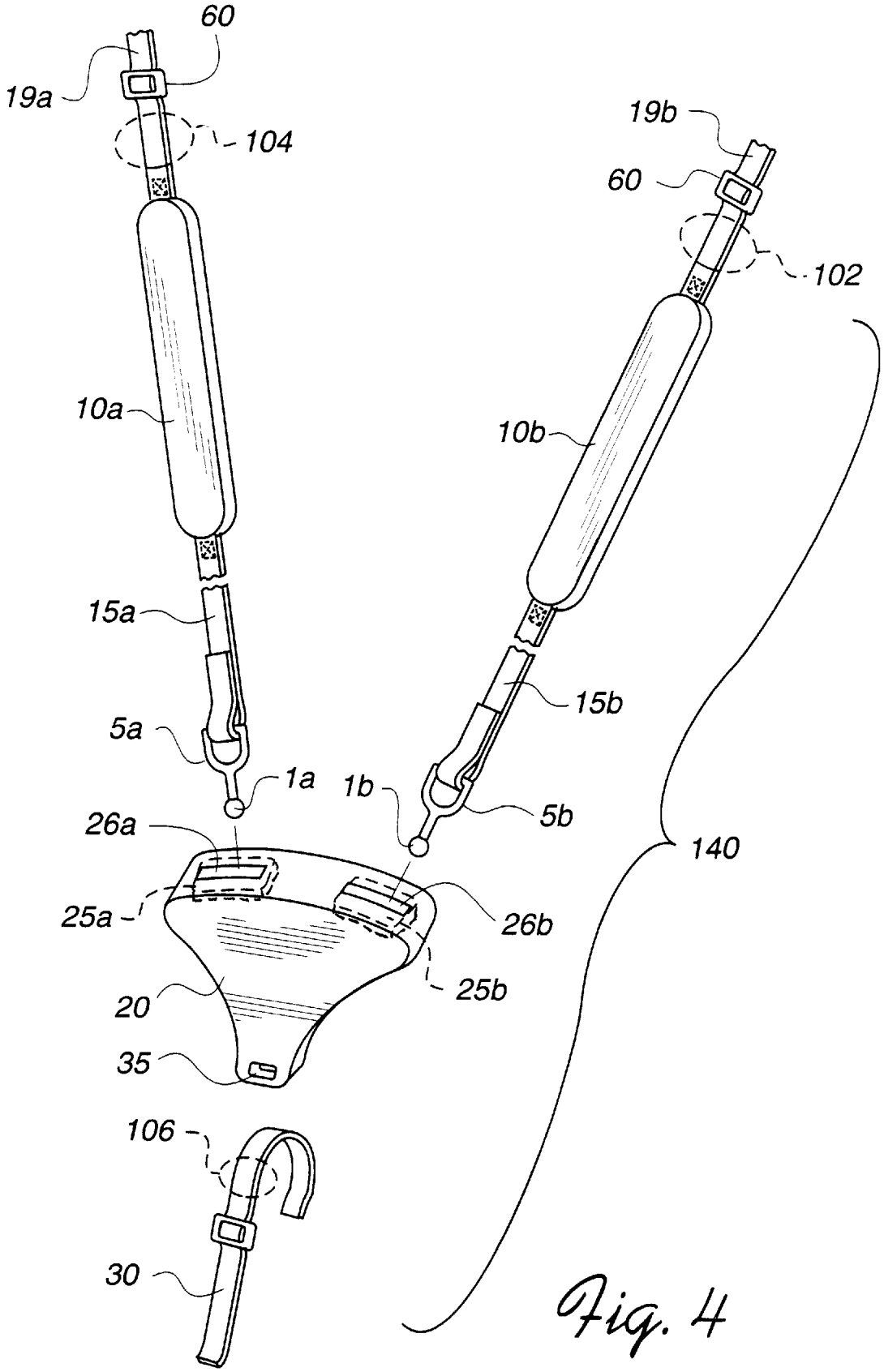
FIG. 4 is a perspective view of carrying straps in accordance with another embodiment of-the present invention.
Figure 5:
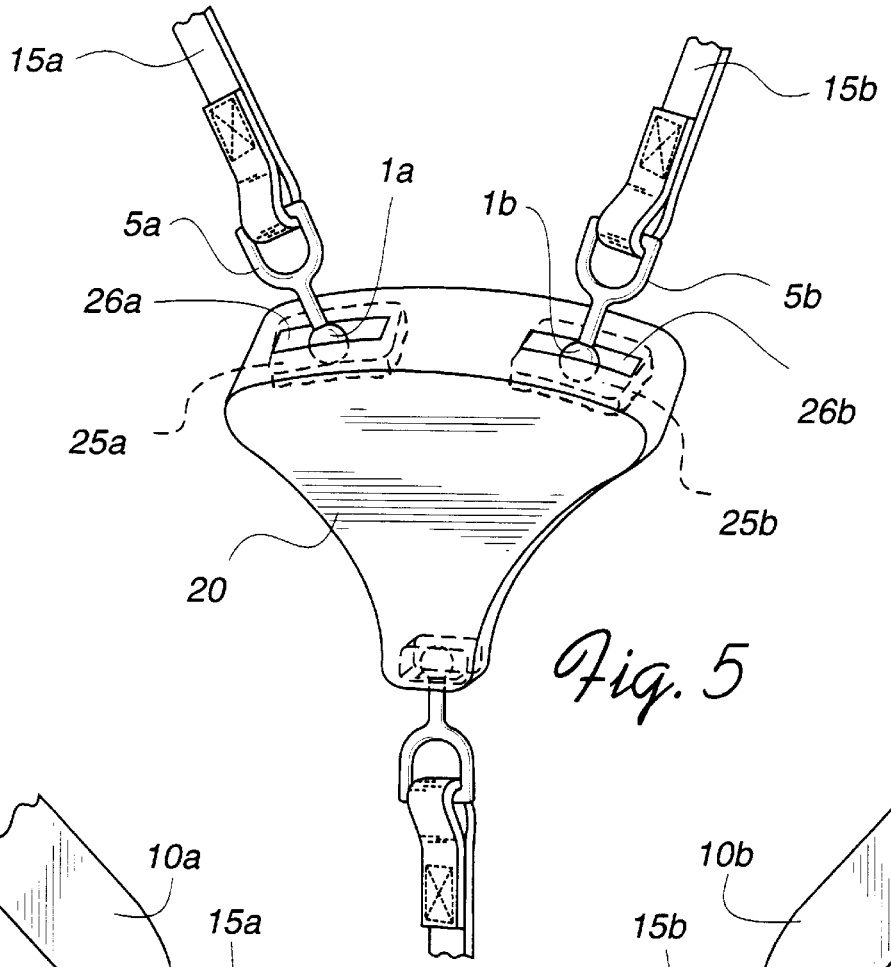
FIG. 5 is a perspective view of the coupler housing in accordance with the embodiment of FIG. 4.
Figure 6:
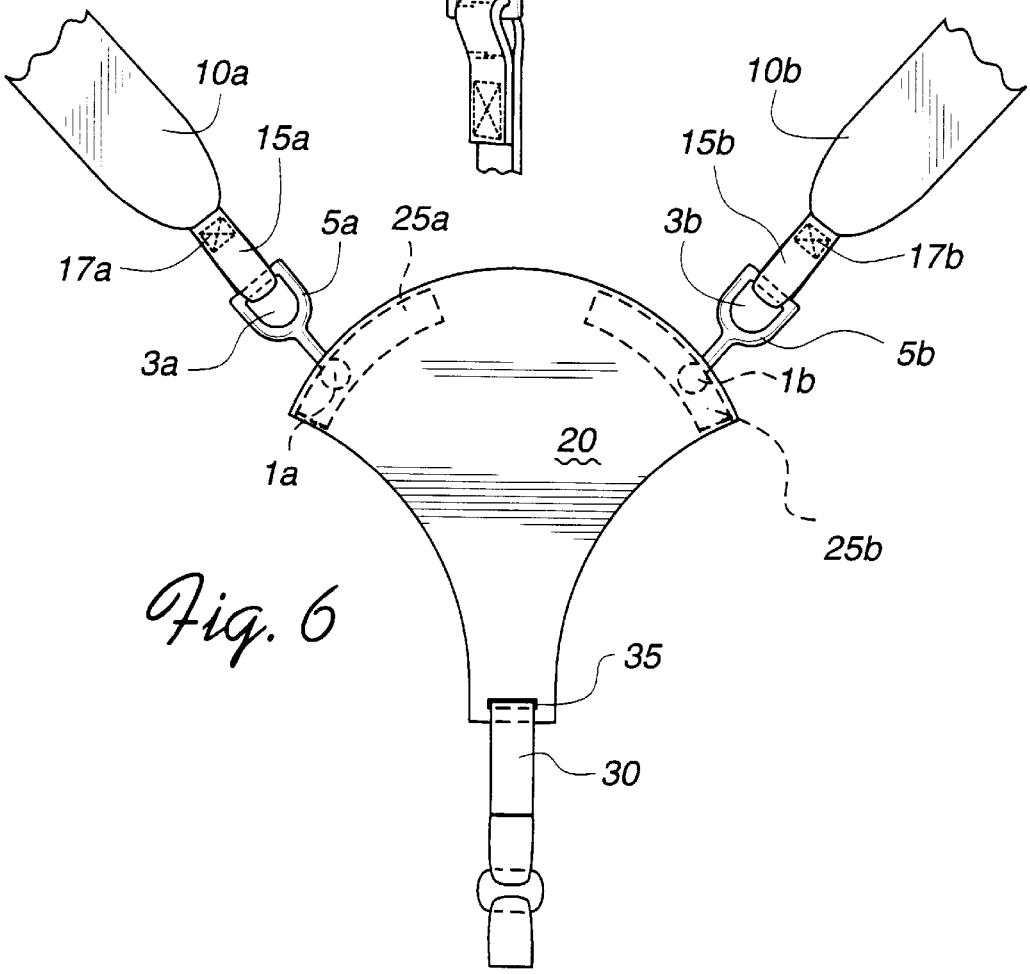
FIG. 6 is a frontal view of a coupler in accordance with the carrying strap of FIG. 4.

In the alternative preferred embodiment, as seen in FIGS. 4 to 6, the coupler 20 is an open fan shaped assembly which contains two tracks 25*a* and 25*b* located opposite each other inside the top portion of the coupler 20. On the top face of the coupler 20, the tracks 25*a* and 25*b* each have a corresponding slot 26*a* and 26*b* partially exposing the center portion of the tracks 25*a* and 25*b*. The tracks 25*a* and 25*b* are configured and designed to house an enlarged spherical end 1*a* and 1*b* of connectors 5*a* and 5*b*, and the slots 26*a* and 26*b* allow the connectors 5*a* and 5*b* to extend from the tracks 25*a* and 25*b* and to be attached to ends 15*a* and 15*b* of the shoulder straps 10*a* and 10*b*. However, the slots 26*a* and 26*b* are designed to prevent the enlarged spherical ends 1*a* and 1*b* from disengaging the tracks 25*a* and 25*b*. Therefore, one of the advantages of the tracks 25*a* and 25*b* is to allow the connectors 5*a* and 5*b* to move back and forth along the length of the tracks 25*a* and 25*b*, and thus, the shoulder straps 10*a* and 10*b* are adjustable to the shoulder width of the golf bag carrier.

In a preferred embodiment, as illustrated in FIG. 6, connectors 5*a* and 5*b* have an open looped head 3*a* and 3*b* on one end of the key connector 5*a* and 5*b*, respectively, and the connectors 5*a* and 5*b* have the enlarged spherical end 1*a* and 1*b* on the opposite end of the connectors 5*a* and 5*b*, respectively. The first ends 15*a* and 15*b* of the shoulder straps 10*a* and 10*b* are passed through the open looped head 3*a* and 3*b* and stitched back on itself at stitch locations 17*a* and 17*b*, respectively. Thus, the straps 10*a* and 10*b* are slidably attached to the coupler 20. Additionally, the coupler 20 has a connector hole 35 where a connector strap 30 is passed through the connector hole 35 and stitched back on itself to secure the connector strap 30 to the coupler 20. Alternatively, in lieu of the connector hole 35, the coupler 20 may be equipped with a track similar to that of track 25*a* for slidably engaging the connector strap 30. This way all three connectors to the coupler 20 are adjustable. As an alternative to the stitching described above, other suitable fastening practices may be used, such as using rivets, adhesives or the like.

Figure 7:
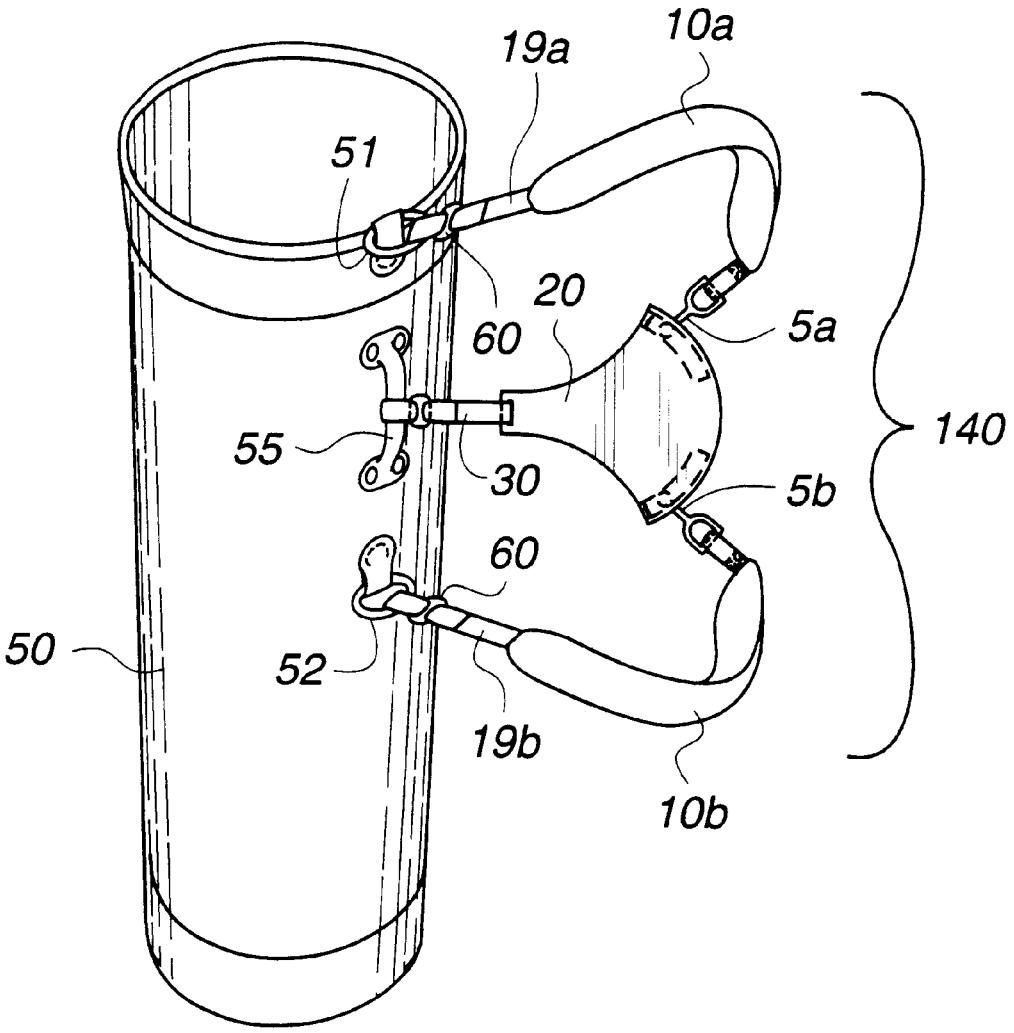
FIG. 7 is a perspective view of the carrying straps of FIG. 4 attached to a golf bag.
Figure 8:
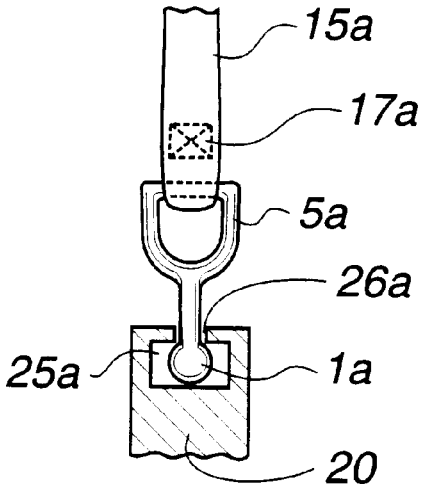
FIG. 8 is a cross-sectional interior side view of the coupler housing of an embodiment of the present invention.

As shown in FIG. 7, the carrying strap 140 is mounted to a golf bag 50 where the second end 19*a* of the shoulder strap 10*a* is connected to a ring 51 on the upper rim of the golf bag 50, second end 19*b* of the shoulder strap 10*b* is connected to a ring 52 on or about the mid-point of the golf bag 50, and the connector strap 30 is attached to a handle 55.

In a preferred embodiment, two adjustable buckles 60, shown in detail in FIG. 12, are used to connect the second ends 19*a* and 19*b* to the rings 51 and 52, respectively. The second ends 19*a* and 19*b* are passed through a first hole 61 and out a second hole 62 of the adjustable buckle 60. Then, the second ends 19*a* and 19*b* are passed through their respective rings 51 and 52, and then passed once again through the opposite side of the first hole 61 to fasten the shoulder straps 10*a* and 10*b* to the golf bag 50. Additionally, the strap connector 30 is secured to a handle 55 of the golf bag 50 by passing through the handle 55 and fastened back on itself through a buckle 32 (similar to the one shown in FIG. 12). Once the strap connector is fastened back on itself, there can be an optional Velcro strip (not shown) which can be wrapped around the strap connector 30 to keep the overlapped strap connector 30 together. Thus, the coupler 20 is attached to the golf bag handle 55 with a minimal amount of loose parts. Alternatively, a clip or spring lock may be used to secure either the strap connector 30 to the handle 35 or the second ends 19*a* and 19*b* to the rings 51 and 52, respectively.

Figure 9:
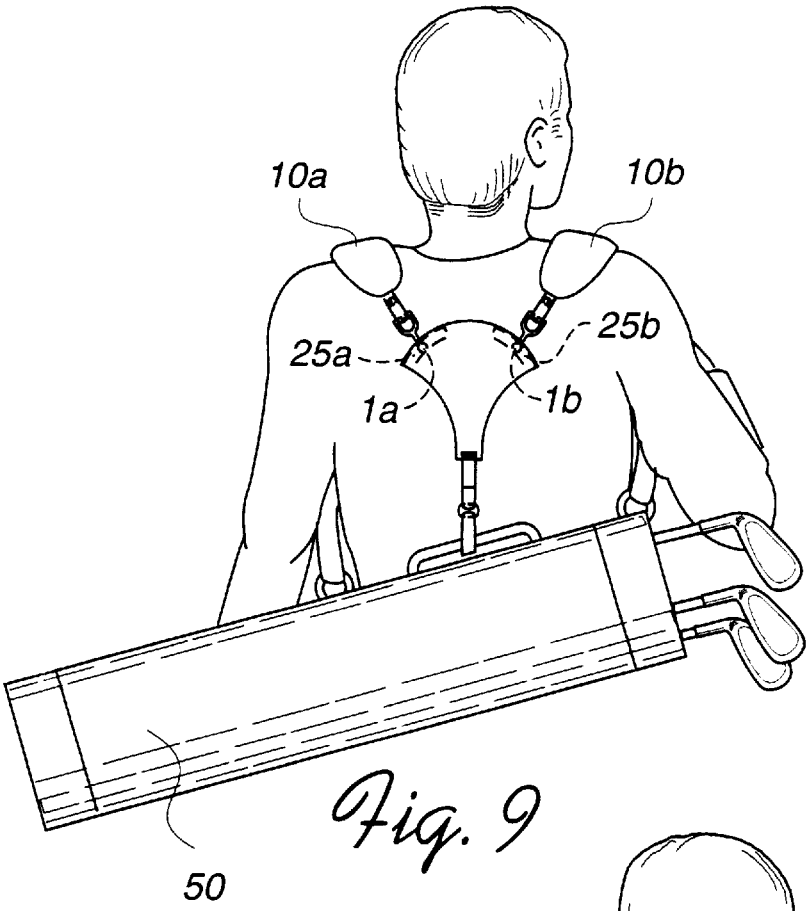
FIG. 9 is a rear view of a person with a small shoulder width carrying a golf bag utilizing the carrying straps of FIG. 4.
Figure 10:
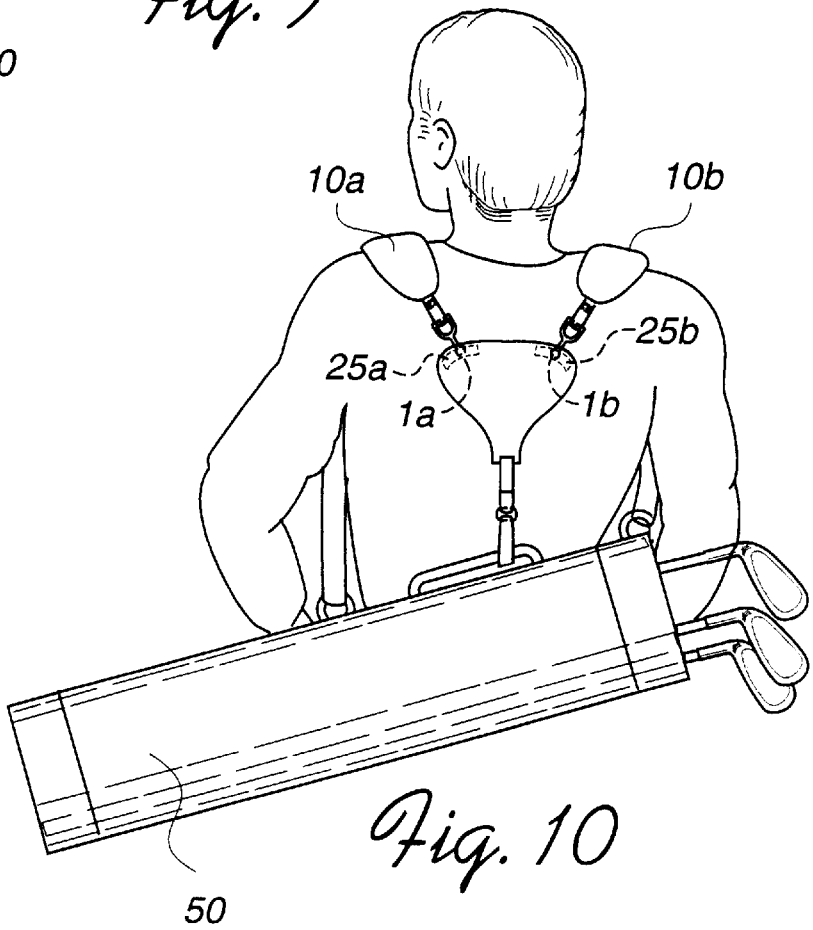
FIG. 10 is a rear view of a person with large shoulder width carrying a golf bag utilizing the carrying straps of FIG. 4.

Therefore, as seen in FIGS. 7, 9 and 10, the carrying strap 140 by being attached to the golf bag 50 forms two openings where an individual can insert his arms through and subsequently place the straps 10*a* and 10*b* over his shoulders to center the weight of the golf bag 50 on the person's back. Additionally, as illustrated in FIGS. 9 and 10, the tracks 25*a* and 25*b* allow the shoulder straps to automatically adjust to the differing widths of the golfers as the connectors move along the track. Therefore, as seen in FIG. 9, narrower shoulders will cause the connectors 5*a* and 5*b* to move closer to the center, while broader shoulders will cause the connectors 5*a* and 5*b* to move further apart, as seen in FIG. 10. In other alternative embodiments, there can be a screw or a locking mechanism installed in the tracks 25*a* and 25*b* which can fix the connector 5*a* and 5*b* to a certain position on the track 25*a* and 25*b* once the desired width (a separation distance between shoulder strips 10*a* and 10*b*) is determined.

In a preferred embodiment of the present invention, the shoulder straps 10*a* and 10*b* are made from a resilient and preferably padded material, such as canvas, nylon, plastic or the like. Moreover, each one of the shoulder straps 10*a* and 10*b* is preferably at least two feet long in length to ensure that where the shoulder straps 10*a* and 10*b* comes into contact with the shoulder blade or collar bone, or any other bone.

Additionally in a preferred embodiment, the coupler 20 and the key connectors 5*a* and 5*b* are made from strong metallic alloy, preferably steel. However, it is possible that only the tracks 25*a* and 25*b* are made of metal and the rest of the coupler is made from hard plastic. Therefore the metal tracks may be surrounded by a hard plastic molding. However, in an alternative, a stronger coupler may be obtained by using only metal to form the coupler 20 can be achieved by casting the metal directly into the shape of the coupler 20. Furthermore, the connectors 5*a* and 5*b* are preferably made as a one-piece molding, but in alternative embodiments, the connectors 5*a* and 5*b* can be made from two or more pieces. For example, the enlarged spherical end 1*a* or 1*b* can be made to screw into the body of the connector 5*a* or 5*b*. The connectors 5*a* and 5*b* can be inserted into tracks where there is a screw or stopper that can be releasably inserted into the end of the track 25*a* and 25*b* from the side panel. Therefore, after the connectors 5*a* and 5*b* are placed in the tracks 25*a* and 25*b*, the screw or stopper is put into place to prevent the connectors 5*a* and 5*b* from falling out. In other alternatives, the top of the tracks 25*a* and 25*b* may be detachable so that the connectors 5*a* and 5*b* can be inserted and housed by the track 25*a* and 25*b*. Afterwards, the top can be replaced and screwed back on.

Figure 11:
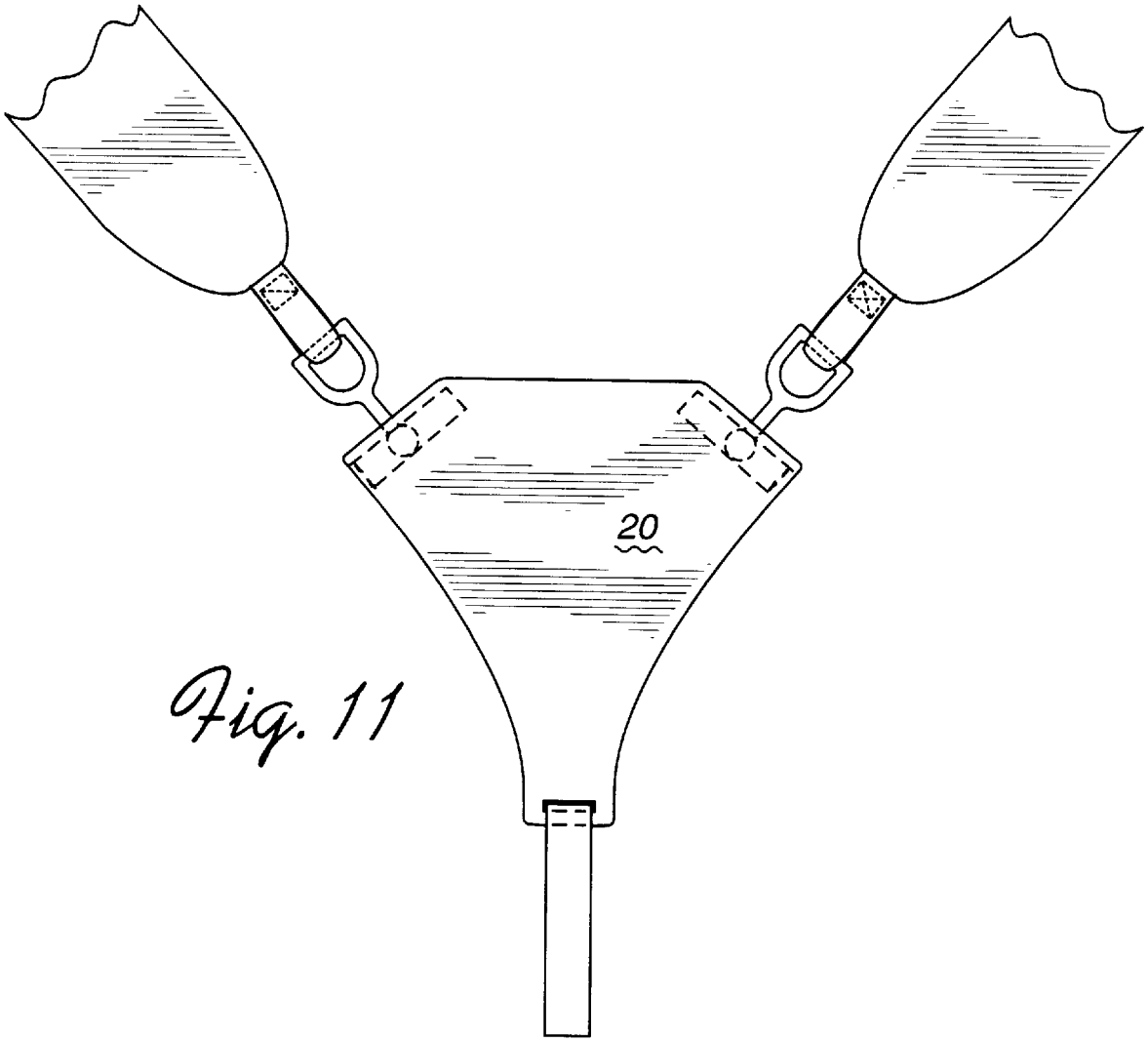
FIG. 11 is another embodiment of the coupler of FIG. 4.

While the description above refers to particular embodiments of the present invention, it should be understood that many modifications may be made without departing from the spirit thereof. For example, the ends 1*a* and 1*b* of key connections 5*a* and 5*b* can be cylindrical shape or any other shape that allow the key connections 5*a* and 5*b* to be movable along the tracks 25*a* and 25*b*. In addition, the shape of the coupler 20 can have a variety of shapes as long as they allow for a means of allowing the straps to be adjustable to the shoulder width of the golfer. For example, FIG. 11 shows a diamond shaped coupler. Additionally, other types of fasteners may be substituted to hold the shoulder straps to the golf bag. Thus, the accompanying claims are intended to cover these and other modifications as would fall within the true scope and spirit of the present invention.

Figure 13:
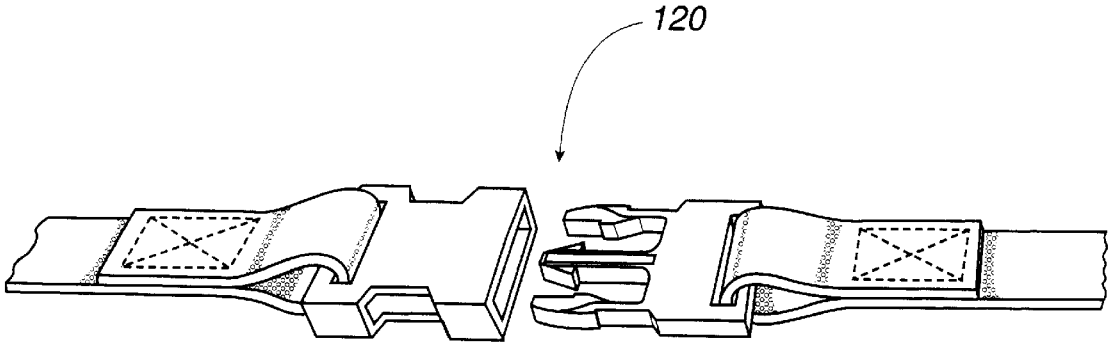
FIG. 13 is a perspective view of a fastener used in the embodiments of the present invention.
Figure 14:
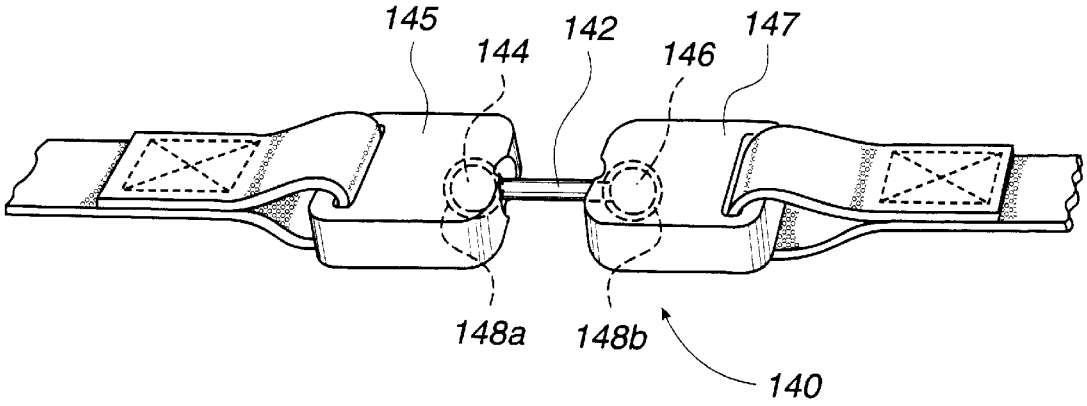
FIG. 14 is a perspective view of a connector used in the embodiments of the present invention.

Moreover, the strap connector 30 in FIGS. 1 and 4 may be equipped, at a location denoted as 106, with a fastener 120 shown in FIG. 13, which is commonly used in bag packs. Similarly, the end straps 72*a* and 72*b* of FIG. 1 or the shoulder straps 10*a* and 10*b* of FIG. 4 may be equipped, at the locations denoted as 102 and 104, with rotatable connectors 140 shown in FIG. 14. The rotatable connector 140 has a rod assembly 142 which includes two spherical ends 144 and 146 at each end. The spherical ends 144 and 146 are placed in first and second chambers 148*a* and 148*b*, respectively, so that a first housing 145 rotates independent of a second housing 147. This is useful since the shoulder pads 10*a* and 10*b* are allowed to freely rotate without tangling or twisting. In another alternative embodiment, the rotatable connector 140 may be used with the connector strap 30 of FIGS. 1 and 4 to allows rotating movement of the shoulder straps.

The presently disclosed embodiments are therefore to be considered in all respects as illustrative and not restrictive. The scope of the invention is therefore indicated by the appended claims, rather than the foregoing description, and all changes which come within the meaning and range of equivalency of the claims are therefore intended to be embraced therein.

What is claimed is:

1. A carrying strap apparatus for use with a golf bag having an opening and an outer sidewall with a first coupler secured near the opening of the golf bag, a second coupler secured near a mid-section of the outer sidewall of the golf bag, and a third coupler secured in between the first and second couplers, the carrying strap apparatus comprising:

a coupling member attachable to the third coupler of the golf bag;

a first elongated member having first and second ends where the first end of the first elongated member is adjustably coupled to the coupling member and the second end is attachable to the first coupler of the golf bag; and a second elongated member having first and second ends, wherein the first end of the second elongated member is adjustably coupled to the coupling member and the second end is attachable to the second coupler of the golf bag, and wherein the coupling member has first and second tracks for moveably coupling the first and second elongated members, respectively, and each one of the first ends of the first and second elongated members has an engaging member for installing in the first and second tracks, the engaging member has having a substantially spherical shape, and when the first and second elongated members are attached to the golf bag, two openings are defined for wearing the carrying strap apparatus on a back of a person.

2. A carrying strap apparatus of claim 1, wherein the first and second tracks are substantially linearly aligned.

3. A carrying strap apparatus of claim 1, wherein the coupling member has a third track for slidably coupling the a connector member to the coupling member.

4. A carrying strap apparatus of claim 1, further including a connector member adjustably disposed between the coupling member and the third coupler to securely attach the coupling member to the golf bag.

5. A carrying strap apparatus of claim 4, wherein the coupling member has a third track for slidably coupling the connector member to the coupling member.

6. A carrying strap apparatus of claim 1, further including at least one buckle member to adjust the length of at least one of the first and second elongated members.

7. A carrying strap apparatus of claim 1, wherein the second end of the first elongated member is attached to the golf bag through a rotatable connector so that the first elongated member is rotatable with respect to the coupling member without twisting.

8. A carrying strap apparatus of claim 1, Wherein the second end of the second elongated member is attached to the golf bag through a rotatable connector so that the second elongated member is rotatable with respect to the coupling member without twisting.

* * * * *